US005111756A

United States Patent [19]

Anderson

[11] Patent Number: 5,111,756

[45] Date of Patent: May 12, 1992

[54] APPARATUS FOR CLEANING CONTAMINATED SOIL

[75] Inventor: John D. Anderson, North Bend, Wash.

[73] Assignee: Enviro-Klean Soils, Inc., Snoqualmie, Wash.

[21] Appl. No.: 704,942

[22] Filed: May 23, 1991

Related U.S. Application Data

[63] Continuation-in-part of Ser. No. 586,268, Sep. 21, 1990, Pat. No. 5,027,721.

[51] Int. Cl.[5] ..... F23D 13/00; F23D 15/00

[52] U.S. Cl. ..... 110/240; 110/236; 110/241; 110/346; 241/DIG. 10

[58] Field of Search ..... 110/236, 346, 240, 110, 110/241; 241/DIG. 10; 34/10, 57 A

[56] References Cited

U.S. PATENT DOCUMENTS

| | | | |
|---|---|---|---|
| 4,738,206 | 4/1988 | Noland | 110/346 |
| 4,821,654 | 4/1989 | Becker et al. | 110/236 |
| 4,974,528 | 12/1990 | Barcell | 110/240 |
| 5,020,452 | 6/1991 | Rybak | 110/241 |
| 5,027,721 | 7/1991 | Anderson | 110/236 |

*Primary Examiner*—Edward G. Favors
*Attorney, Agent, or Firm*—Robert A. Jensen

[57] ABSTRACT

A portable machine for sanitizing soil, particularly that contaminated with petroleum products, including a closed main chamber including vertically spaced augers (26,28,30) which agitate the soil while moving it into position to fall in parallel sheets after it strikes a separation bar 52. A burner 44 generates heat which passes through the falling soil driving off the petroleum which is then burned.

3 Claims, 6 Drawing Sheets

FIG. 3
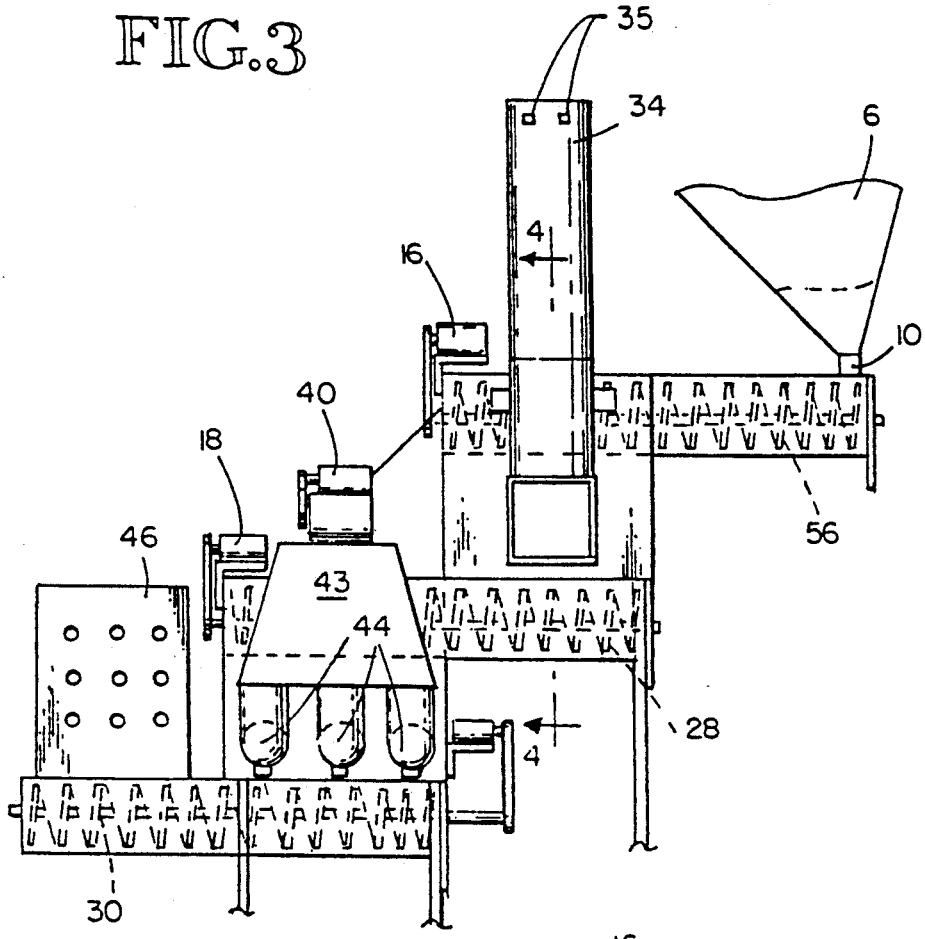
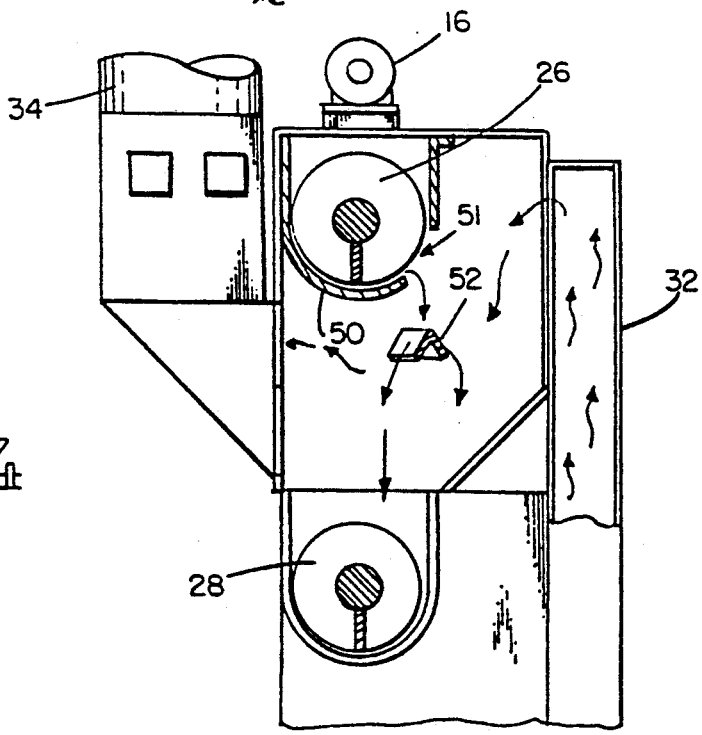
FIG. 4

FIG.5
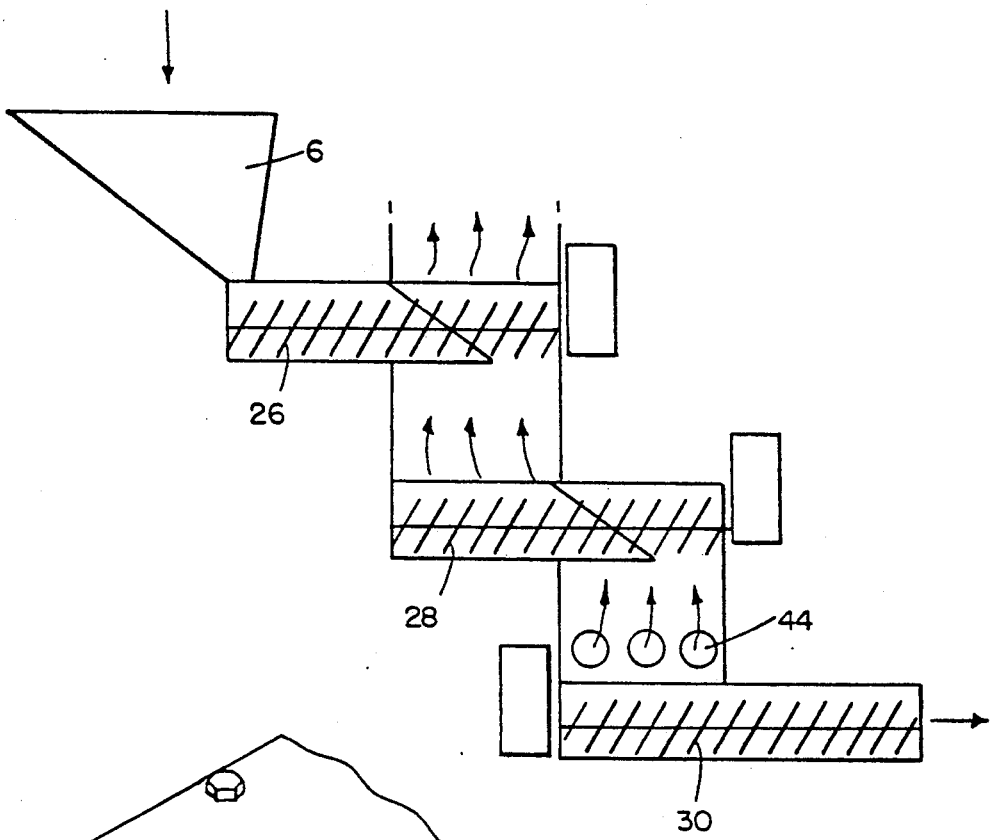
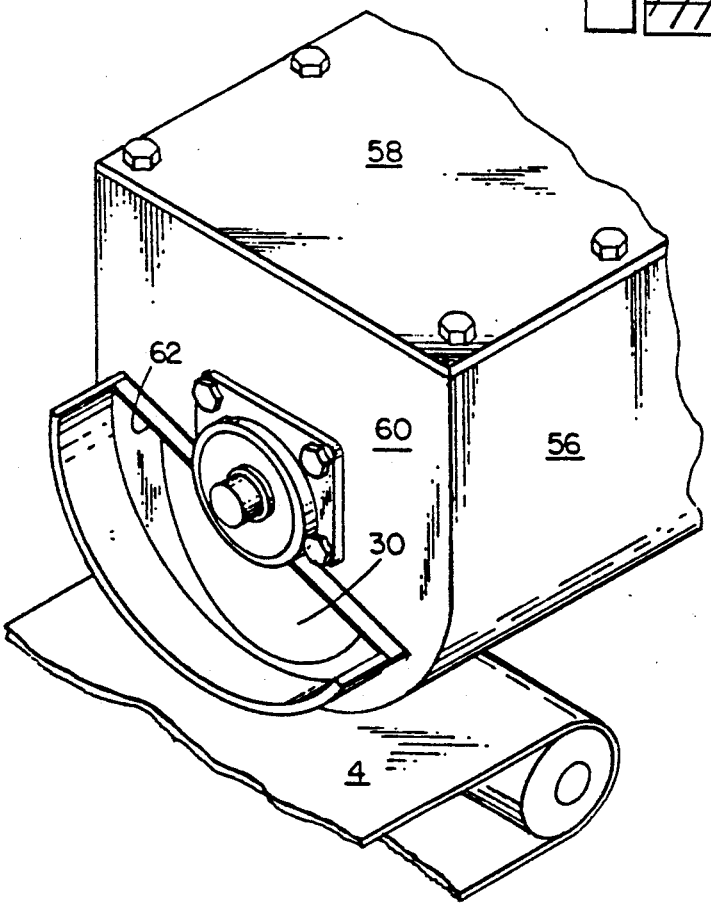
FIG.6

APPARATUS FOR CLEANING CONTAMINATED SOIL

This application is a continuation in part of U.S. patent application Ser. No. 07/586,268 filed Sep. 21, 1990, now U.S. Pat. No. 5,027,721.

TECHNICAL FIELD

This invention relates to the field of cleaning contaminated soil and more particularly to the removal of hydrocarbons through the combination of forcing hot air through a multi-stage curtain of falling soil and then burning the gases driven off to reduce them to carbon dioxide and water wherein the entire apparatus is placed upon a single trailer such that it may be moved from site to site and the end product is environmentally safe.

BACKGROUND ART

Historically, people have not been overly concerned about the fact that some of the petroleum storage tanks have leaked and/or that there have been minor spills. Unfortunately, the number of minor spills that occurred in places, such as service stations or vehicular repair facilities to mention two, have been cumulative, such that the soil surrounding the facility and/or tanks have become saturated or close thereto. There is a current concern, compounded by our more realistic assessment of damage done by these spills, as to the long-term effect upon health, such as through the contamination of ground water or the like.

Up until this point in time, the primary approaches that have been taken to the petroleum contamination problem have included farming the soil, i.e. placing it in a fallow field and turning it allowing the volatiles to evaporate and escape into the atmosphere, not necessarily a viable alternative or subjecting the soil to extremely high heat and/or agitation over a long and tortuous path to drive off the volatiles, and then either filter the escaping air or subject it to high temperatures to ignite the material driven off.

Examples of apparatus and methods used for cleaning contaminated soil and/or reducing other contaminants are shown in the prior art noted during a preliminary patentability search include:

U.S. Pat. No. 3,570,420 granted to Lewis, et al, Mar. 16, 1971, which discloses an apparatus for removal of the hydrocarbon content of cuttings from subterranean wells by combustion.

U.S. Pat. No. 4,009,667 granted to Tyer, et al, on Mar. 1, 1977, discloses an incinerator wherein combustible refuse is carried through a combustion chamber by means of a variable speed auger, and a portion of the exhaust gas is recirculated to preheat the entering refuse.

U.S. Pat. No. 4,202,282 granted to Hobbs, et al, on May 13, 1980, discloses a method and apparatus for processing sewage sludge through the use of infrared radiation under a slight vacuum to capture the noxious odors.

U.S. Pat. No. 4,231,304 granted to Hoskinson on Nov. 4, 1980 discloses a waste combusting apparatus including a hollow auger through which air is forced to improve combustion. Secondary combustion is provided with respect to the waste gases.

U.S. Pat. No. 4,337,711 granted to Bolton, Jul. 6, 1982, discloses a method and apparatus for the combustion of petroleum wastes wherein the wastes are mixed with combustible solids, such as wood chips, and then the mixture is incinerated.

U.S. Pat. No. 4,338,869 granted to Hoskinson, Jul. 13, 1982, discloses a combustion apparatus, including a hollow auger through which air is forced to improve the combustion.

U.S. Pat. No. 4,342,269 granted to Hoskinson, Aug. 3, 1982, discloses an incinerator having a hollow auger for transporting the material to be burned and for transporting air to improve the combustion and also including a means to cool the auger.

U.S. Pat. No. 4,357,152 granted to Duske, et al, Nov. 2, 1982, discloses a particulate separator which uses an interior configuration of a tapered cylinder to increase the turbulence to assist in the separation.

U.S. Pat. No. 4,558,525 granted to Duske, et al, Dec. 17, 1985, discloses a rotary drying system for particulate material utilizing differently configured cylinders to increase the turbulence and promote efficient drying.

U.S. Pat. No. 4,648,332 granted to Goodhart, Mar. 10, 1987, discloses a method of cleaning contaminated soil by subjecting it to heat in a combustion chamber including a fluidized bed.

U.S. Pat. No. 4,648,333 granted to Mudd, et al, Mar. 10, 1987, discloses a method for treating oil field wastes containing hydrocarbons, wherein fuel and pressurized air are inserted into the furnace, wherein the hydrocarbons are burned utilizing the hydrocarbons as a source of combustion for its treatment.

U.S. Pat. No. 4,667,609, granted to Hardison, et al, May 26, 1987, discloses an apparatus for the treatment of soil contaminated with hydrocarbons, including a sealed negatively pressurized high temperature furnace wherein the multizone heater is maintained at about 2900° F.

U.S. Pat. No. 4,815,398 granted to Keating, II, et al, Mar. 28, 1989, discloses an apparatus and method for detoxifying soils, including an apparatus for heating the material to a first temperature to volatilize the volatile organic compound which is then heated to destroy the organics, and this volatile rich gas is used as fuel for heating a kiln.

U.S. Pat. No. 4,870,911 granted to Chang, et al, Oct. 3, 1989, discloses an incinerator pyrolyzer for continuously burning waste material in a rotating kiln.

U.S. Pat. No. 4,881,475 granted to DeLeur, Nov. 21, 1989, discloses a method for cleaning contaminated soil through the use of heated wall of a rotating furnace.

DISCLOSURE OF THE INVENTION

With the above-noted prior art in mind, it is an object of the present invention to provide a self-contained mobile vehicular mounted device for the on-site decontamination of soil containing volatile organic compounds.

It is another object of the present invention to provide a device for sanitizing contaminated soil wherein the soil is caused to fall in sheets through which heated air is driven.

It is yet another object of the present invention to provide a soil decontamination device wherein the soil itself forms a seal preventing the escape of the contaminated vapors.

Still a further object of the present invention is to provide a device wherein contaminated soil is treated until all of the end products are environmentally acceptable.

BRIEF DESCRIPTION OF THE DRAWINGS

FIG. 3 is a vertical cross-section of the inventive device.

FIG. 4 is a section taken along lines 4—4 of FIG. 3.

FIG. 5 is an enlarged view showing the discharge from the device and the seal formed.

FIG. 6 is a schematic depicting the flow of material through the device and the flow of the heated air through the material.

BEST MODE FOR CARRYING OUT THE INVENTION

Figure 1:
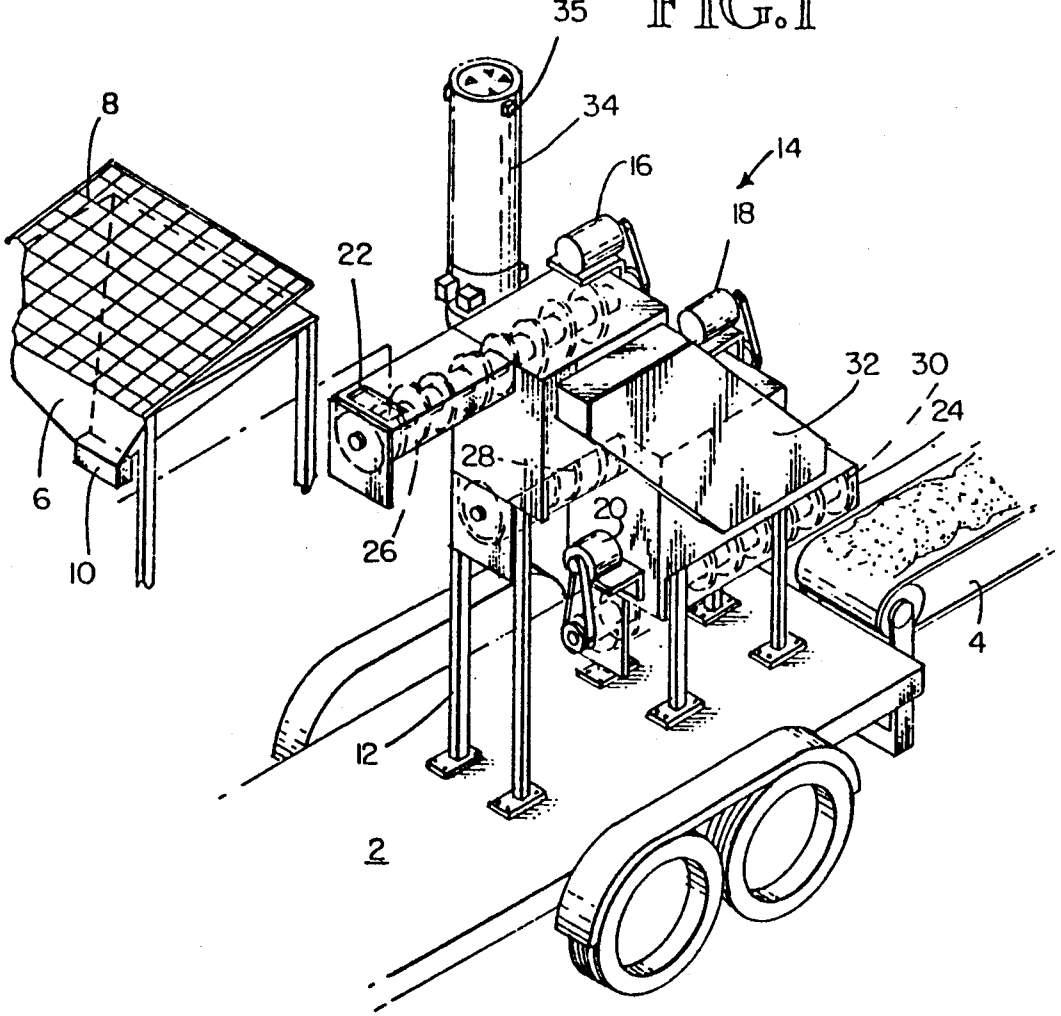
FIG. 1 is an isometric view of the decontamination device located upon a supporting trailer.

As seen in FIG. 1, the inventive device is supported upon a trailer 2 or other transport device such that it may be moved from site to site to decontaminate soil at the location and return the soil to the location eliminating the need for costly transport. As seen in this view, the decontaminated soil is carried away by a conveyor device 4, but any suitable device for removing the soil may be used. The machine is capable of processing soil at a rate of 5-20 cubic yards per hour.

The contaminated soil is loaded into a hopper 6 by any suitable means, but prior to entering the hopper itself, the material passes through a sizing screen 8 eliminating any rocks that are too large to be handled and, in the preferred situation, all items larger than 2" would be thus eliminated. The bottom or discharge end 10 of the hopper is sized such that it is substantially continuously closed by material to be processed preventing the escape of any gases. (See FIG. 3.) As an alternative, the hopper could be located near the ground and the soil carried off by conveyor.

The main part of the apparatus is mounted upon supporting legs 12 and comprises a closed main body portion 14 which is encapsulated in a metal skin substantially preventing the escape of any gases and likewise containing and controlling both the flow of the contaminated material and the heated gases used for volatilization. Also seen in this view are the drive motors 16,18,20 for driving the augers 26,28 and 30 (shown in phantom) which convey the soil from the entry port 22 which mates with exit opening 10 of bin 6 to the exit end 24. The decontaminated soil is discharged onto conveyor 4.

An exterior conduit 32 is utilized to transport the heated air from chamber to chamber, and a stack 34 is used to permit safe escape or discharge of the decontaminated but heated gases.

Figure 2:
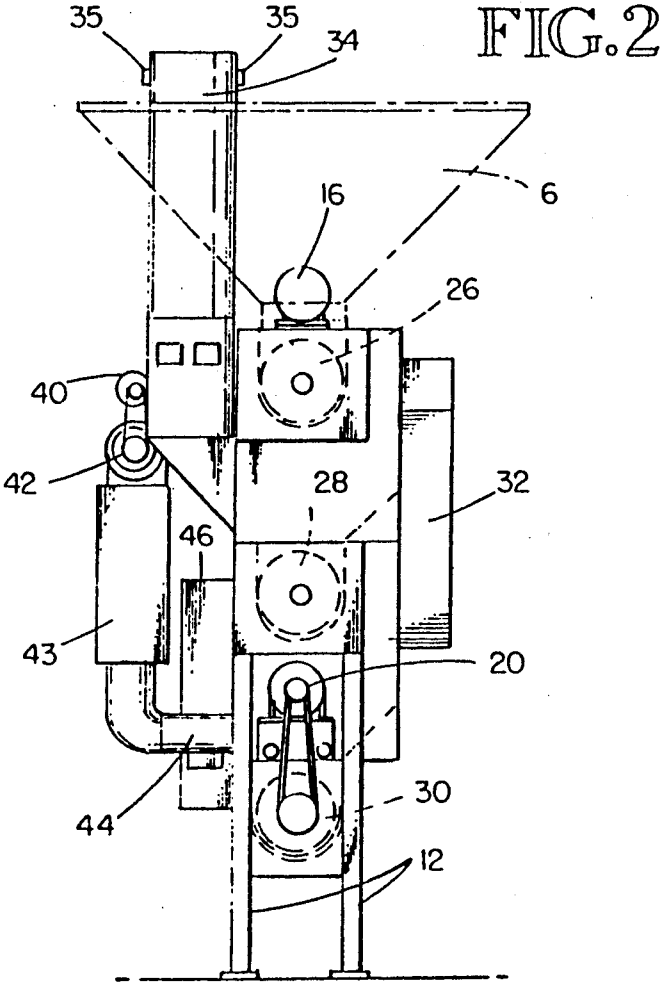
FIG. 2 is an end elevation of the inventive device.

As seen in FIG. 2, the three augers which move the dirt are placed in the same vertical plane to make the unit as compact as possible and the soil, as explained hereinafter, cascades downwardly from one station to another. The earth, as it moves through the first two stations is caused to cascade by a combination of an elongated, angled, substantially triangular opening in the bottom of the auger trough (see FIG. 4) and a breaker bar 52 immediately below the slot. At the left-hand portion of the device as shown in FIG. 2, there can be seen a motor 40 which drives a fan 42 which forces air downwardly into the burner section 44, which includes a plurality of burners to more easily control the heat, where the heated air is then exited into the chamber above the bottommost auger 30. The fan 42 draws ambient air, which can be preheated through a heat exchanger heated by escaping gases and forces it to the burner. All air utilized by the inventive machine is provided by fan 42.

A control panel 46 is located adjacent the burners to control all of the operations of the present invention.

Referring now to FIG. 3, it can be seen that the burner 44 is in actuality three separate gas burners, in this embodiment, which heat a large volume of air to a temperature which varies with the degree of contamination and can reach as high as 1500° F., which is then forced through the contaminated soil.

As seen in FIG. 4, the air that has been passed through the curtain of contaminated soil in the lower chamber between auger 28 and 30 then passes up in conduit 32 and passes through the earth cascading from auger 26 to 28. As shown in this view, the heated air passes through the curtain and then out the stack 34. Provision is made for burning any additional gases that remain in the stack prior to exiting them. The contaminated earth which has been fed into the enclosure for auger 26 leaves the enclosure having a curved bottom 50 through an opening which is substantially triangular if viewed when enclosure sheet 50 is in planar form, but since it is placed at an angle to the axis of curvature at sheet 50 has a slight helix configuration. The opening generally designated as 51 is of a size and shape such that it controls the configuration of the discharge. The material falls downwardly contacting a bar 52 which causes the earth to fall downwardly towards 28 in a pair of substantially parallel curtains exposing the maximum amount of material to the heated air.

As seen in FIG. 5, the decontaminated earth exits the device at the end of auger 30 through an opening which is of a size that it is always blocked by treated earth preventing the escape of gases. The discharge of the device is characterized by an exterior sheet metal container 56 having a removable cover 58 and including an end panel 60 including an opening 62 in the shape of a segment of a circle such that it is slightly smaller than would freely handle the material carried by auger 30 causing the material to be backed up and thus forced through the opening closing same.

FIG. 6 schematically shows that the contaminated earth enters the device through the hopper 6 (closing the top of the device), passes along auger 26, exiting and cascading downward to auger 28, exiting and cascading downward past the burners 44 to auger 30, and then it is exited. Air heated by the burners 44 passes through the curtain of cascading dirt between 28 and 30 and then moves upwardly to pass through the cascading dirt between augers 26 and 28 and then exits via stack 34 after any contaminants are removed.

The amount of heat, amount of air, rate of feed and number of cascading stages will depend upon the amount of and type of contamination.

Figure 7:
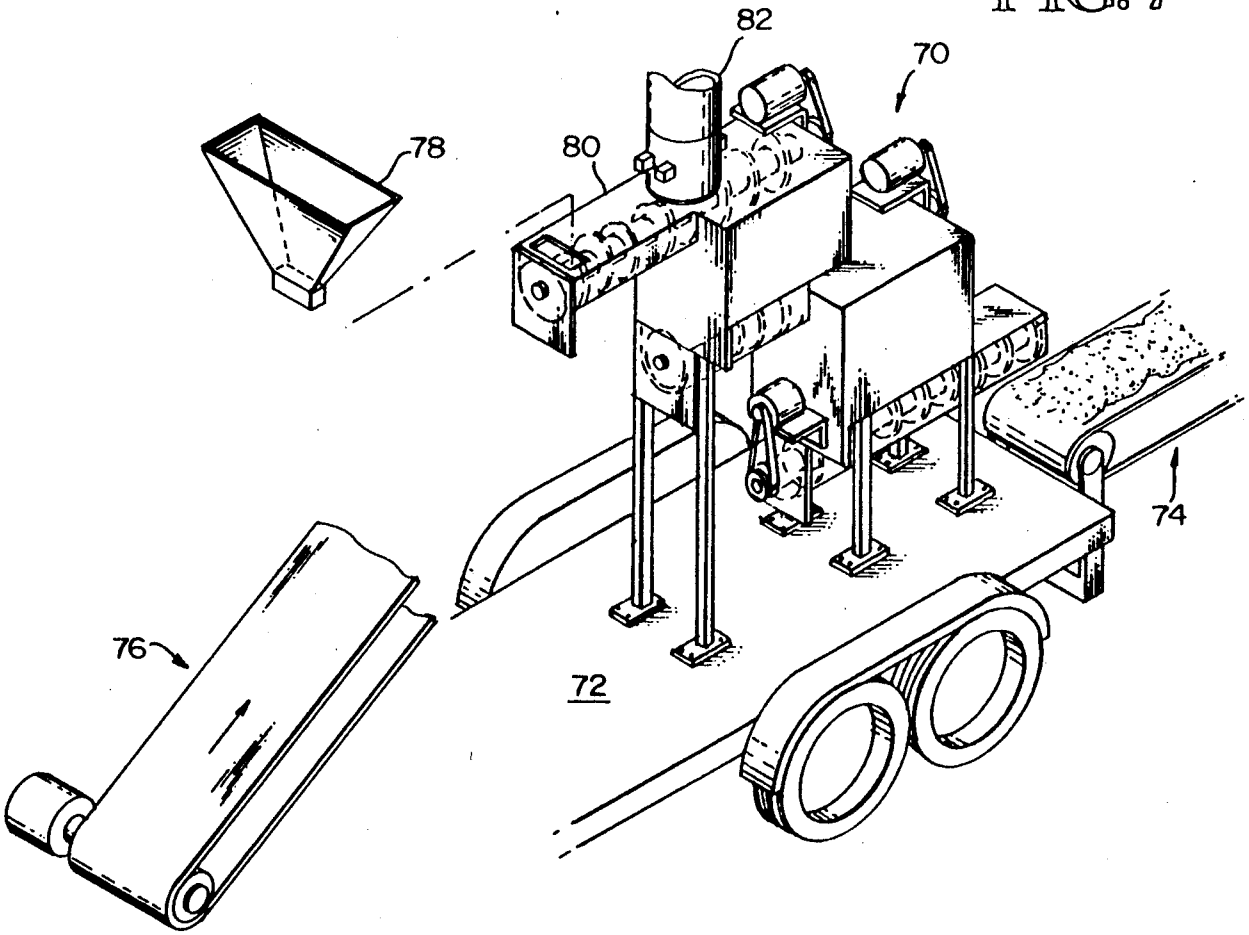
FIG. 7 is a second embodiment of the present invention.

As seen in FIG. 7, the decontamination unit generally designated as 70 is mounted upon a trailer 72 and includes as adjunct equipment a conveyor system 74 for removing the decontaminated soil as well as a feeder belt 76 which carries the contaminated soil upwardly to be exited in hopper 78 which is mounted above the first stage 80 of the decontamination process. A screening process will occur prior to the soil being placed upon belt 76.

The decontamination process for this embodiment is identical to that of the earlier embodiment with the dirt being mixed and turned as it goes through the various stages with it cascading from one stage to another in a curtain such that it has maximum exposure to the air which is driving off the volatiles. In order to create more of a back pressure and thus retain more of the heat within the chamber, the stack 82 has been moved to a position on top of the first chamber causing the heated gases from the second and third chambers to pass through the contaminated soil as it is being introduced.

Figure 8:
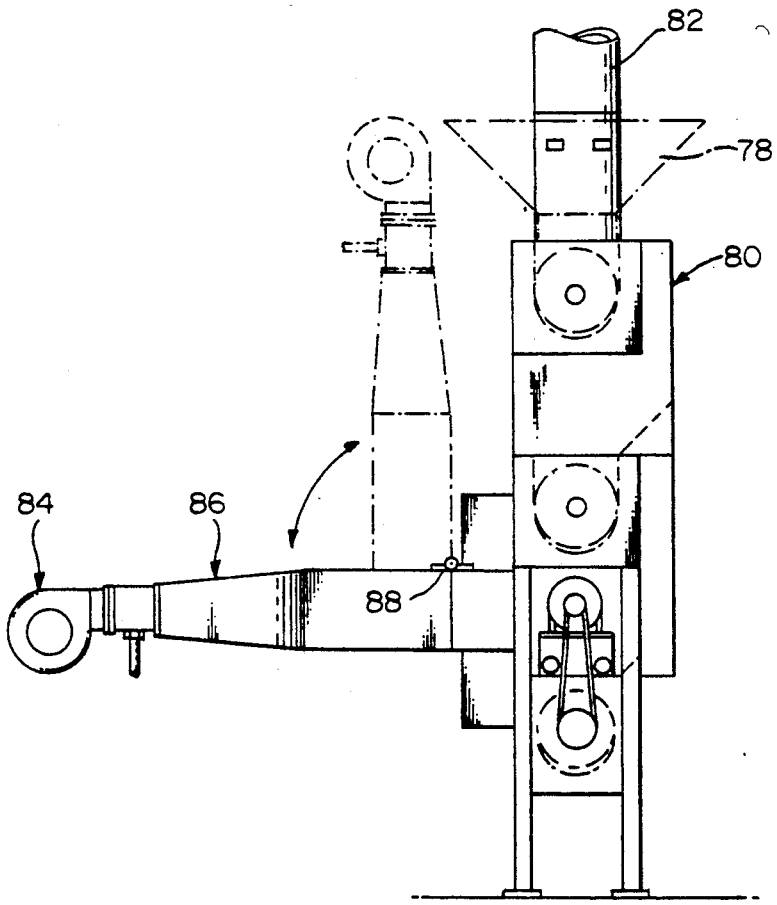
FIG. 8 is an end elevation view of the embodiment of FIG. 7.
Figure 9:
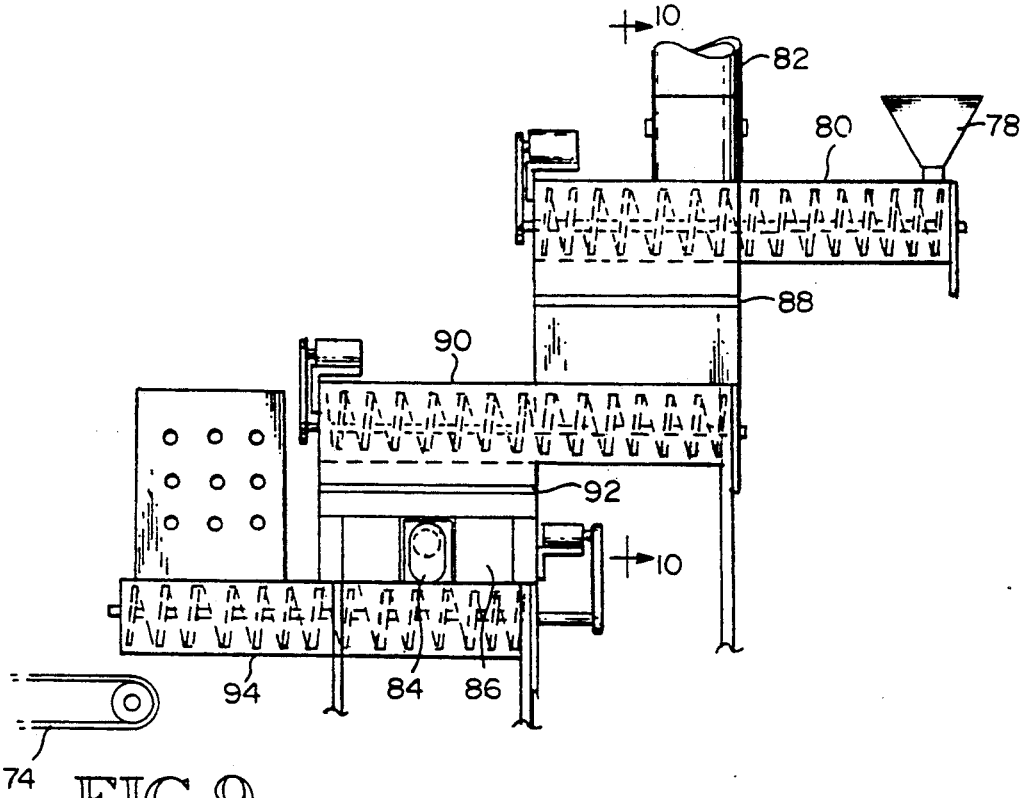
FIG. 9 is a vertical section of the embodiment of FIG. 7.

Referring now to FIG. 8, it can be seen that in this embodiment a single burner 84 is used which has a higher heat capacity and includes as an integral part a blower. Because of the fact that the heat is concentrated in one burner, the heat must be moved further from the decontamination element and therefore, a duct work device 86 is provided to channel the heat from the burner 84 to the third chamber of the decontamination machine. Because of the necessity of moving the machine from site to site, the duct chamber 86 is hinged as at 88 allowing the burner and the duct work to be pivoted upwardly paralleling the side of the decontamination device for transportation to a new site. Referring now to FIG. 9, it can be seen that the hot air from the blower 84 will circulate upwardly exiting through stack 82 carrying the volatiles therewith, whereas the dirt which has been screened an determined to be contaminated enters through the hopper 78 passing through first stage 80 cascading over the divider bar 88 to the second stage 90 or divider bar 92 to the third stage 94 for eventual exit on conveyor 74.

Figure 10:
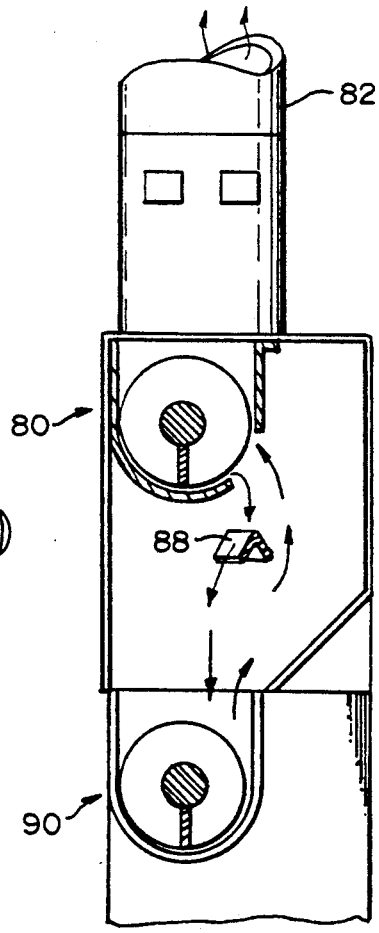
FIG. 10 is a vertical section along lines 10—10 of FIG. 9.

The path of the dirt and the hot gas is more easily seen in FIG. 10 which is a sectional taken along the lines 10—10 of FIG. 9.

I claim:

1. A self-contained device for sanitizing contaminated soil comprising:

a vertically stacked multi-compartment, substantially sealed sanitizing unit wherein each compartment includes an auger to stir and move the soil and including means causing the soil to fall in a sheet to the next lower compartment, said unit mounted upon a trailer for easy transportation to the site of the contamination, and including a soil entry hopper and an exhaust release stack mounted on top of the upper-most compartment and a heat generating means at the lower portion of the device whereby heated air is circulated through the soil as it cascades downwardly through each stage of the device driving off the volitiles.

2. A device as in claim 1, wherein the heat generating means is a single burner mounted a sufficient distance from the lowest compartment to permit the heat to enter the compartment along substantially the entire length thereof.

3. A device as in claim 2, wherein the heat generating means is pivotably secured to the device so that it may be transported more easily.

* * * * *